United States Patent [19]

Yoshimi et al.

[11] Patent Number: 4,818,602

[45] Date of Patent: Apr. 4, 1989

[54] HYGROSCOPIC COMPOSITE MATERIAL

[75] Inventors: Satoshi Yoshimi; Akira Matsuoka; Kazuhiko Asano, all of Osaka, Japan

[73] Assignee: Daiken Trade & Industry Co., Ltd., Toyama, Japan

[21] Appl. No.: 95,576

[22] Filed: Sep. 11, 1987

[30] Foreign Application Priority Data

| | | | |
|---|---|---|---|
| Sep. 12, 1986 | [JP] | Japan | 61-216772 |
| Sep. 12, 1986 | [JP] | Japan | 61-216773 |
| Sep. 12, 1986 | [JP] | Japan | 61-216774 |

[51] Int. Cl.[4] ..... C04B 32/02; D32B 1/16

[52] U.S. Cl. ..... 428/304.4; 428/307.3; 428/315.5; 428/316.6; 428/701

[58] Field of Search ..... 428/188, 137, 304.4, 428/307.3, 315.5, 315.7, 316.6, 701; 55/387

[56] References Cited

FOREIGN PATENT DOCUMENTS

| | | | |
|---|---|---|---|
| 2242241 | 5/1975 | France | 428/304.4 |
| 11890 | 1/1979 | Japan | 55/387 |
| 31425 | 3/1981 | Japan | 55/387 |
| 1138646 | 6/1986 | Japan | 428/304.4 |
| 1130542 | 6/1986 | Japan | 428/316.6 |

*Primary Examiner*—Nancy A. B. Swisher

*Attorney, Agent, or Firm*—Wenderoth, Lind & Ponack

[57] ABSTRACT

A hygroscopic composite material comprising a humidity absorbing body having hygroscopic fillers in its basic material and a porous body having many micropores. This hygroscopic composite material retains its hygroscopicity for a long period of time by enhancing its humidity absorbing function by generating free water in the porous body and by discharging the free water.

8 Claims, 3 Drawing Sheets

HYGROSCOPIC COMPOSITE MATERIAL

BACKGROUND OF THE INVENTION

1. Field of the Invention

This invention relates to a highly hygroscopic composite material suitable for use as an interior panel material, a wall material, a hygroscopic member, etc. of a structure.

2. Desription of the Prior Art

As a material for absorbing humidity in rooms and storehouses, there are available timbers, zonotolite system calcium silicate plates and paper impregnated with hygroscopic fillers. However, each of these materials has disadvantages in that it does not have a satisfactory humidity regulating function, and requires time and energy for dehumidification because when it takes up humidity in the air as adsorbed water and reaches saturation, it cannot absorb humidity any more.

SUMMARY OF THE INVENTION

The present invention has been made in view of the above disadvantages of the conventional materials and has for its object to provide a hygroscopic composite material which can retain its hygroscopicity for a long period of time, by generating free water in the material, by conducting moisture absorption and then by discharging said free water.

In order to attain the above object, the hygroscopic composite material according to the present invention incorporates a humidity absorbing body comprising a basic material with hygroscopic fillers in its voids and a porous body having many micropores, into a composite body.

Also, the present invention is so composed that free water generated in the porous body is discharged outside the material through water discharging holes made in the porous body. In addition to the above basic composition, it has such construction that humidity absorption is oriented so that humidity passes through the porous body from the hygroscopic body side by providing a humidity intercepting layer at an exposed side of the porous body.

In the present invention, it is possible to provide a humidity absorbing body at each side of the porous body, to provide a humidity absorbing body at each side of the porous body having water discharging holes or to form a void in the humidity absorbing body, in which the porous body is filled. The hygroscopic composite material as composed above, if it absorbs humidity from the side of the humidity absorbing body under the condition of fixed temperature, presents the following phenomena.

(1) The percentage of water content on the side of the porous body becomes higher than the percentage of saturated humidity content (the state where the equilibrium is reached by absorbing humidity) of the porous body itself due to generation of free water.

(2) There are cases where while the percentage of water content on the side of the porous body increases, that on the side of the humidity absorbing body does not increase and in such cases, humidity absorbed moves into the porous body.

(3) If humidity absorption is conducted for a long period of time, water trickles down from the porous body.

The above phenomena indicate that humidity in the air absorbed into the humidity absorbing body moves to the porous body, in which it turns into water.

The mechanism by which free water is generated is not fully understood but it is assumed that under the condition of a low percentage of equilibrium water content and a high temperature, while humidity which cannot be absorbed up at a substantial part (the part other than voids) and is allied to saturated vapor exists in micropores, the humidity absorbing body is high in the percentage of equilibrium water content and has humidity absorbing power in reserve, unless hygroscopic fillers absorb humidity perfectly, and therefore micro difference in vapor pressure and in temperature is generated at the interface between the two which are incorporated in one body, with the result that humidity condenses on the side of the porous body which is almost saturated and water is generated.

It has been confirmed by experiments that in such a state as above, liquefaction is promoted by cohesive energy in the case where the diameter of micropores of the porous body is less than 10 $\mu$, especially less than 3$\mu$, but in the case where the diameter of micropores is more than 10$\mu$ (for example, filter paper whose average diameter of micropores is about 20$\mu$), cohesive power is small and it becomes difficult for humidity to turn into waterdrops, with the result that humidity absorbing effect becomes small.

It must be noted that in the actual use of the material according to the present invention, there are changes of temperature and therefore when the temperature lowers, condensation of humidity in the porous body increases further and water retention in the porous body develops.

In the case where the hygroscopic composite material absorbs humidity continuously under the condition of high temperatures, free water is generated in a large quantity in the porous body and the porous body cannot retain all the free water generated and thus water trickles outside the porous body.

On the other hand, under the usual atmospheric condition the voids in the humidity absorbing body are rarely filled with condensed water and therefore hygroscopic fillers within the body rarely flow out and hygroscopicity can be retained for a long period of time. Also, generation of free water contributes to effective fire prevention because such water checks the rise of temperature at the outbreak of a fire.

In this case, if a humidity intercepting layer is provided at an exposed side of the porous body, humidity absorption into the hygroscopic composite material is effected only from the side of the humidity absorbing body due to existence of the humidity intercepting layer, and therefore the difference in vapor pressure at the interface where the humidity absorbing body and the porous body connect with each other occurs with ease and condensed water generates easily at the micropores in the porous body.

If water discharging holes are made in the porous body, when the hygroscopic composite material absorbs humidity under the condition of a higher temperature free water is generated in a large quantity and water trickles through the water discharging holes of the porous body. Collection of water is promoted, if water is sucked positively from the water discharging holes by using a proper suction means.

As mentioned above, according to the humidity absorbing panel of the present invention, more water than can be absorbed by the porous body as a simple substance can be taken up as free water and therefore hygroscopicity is improved. In addition, if retention of free water by the porous body reaches the fullest extent, water is discharged outside the porous body. Accordingly, time and energy required for dehydration can be minimized and continuous humidity absorption from the humidity absorbing body side is made possible. In other words, hygroscopicity can be retained for a long period of time, the desired humidity regulating function can be displayed and the fire preventive function can be improved.

Under the atmospheric condition where humidity is generated in a large quantity, water in the porous body can be removed quickly by sucking it from the porous body by a proper sucking force. Thus, the material according to the present invention can be used not only as wall materials of a structure but also as a dehumidifier.

In the case where water discharging holes are made in the porous body, free water in the porous body is discharged through the water discharging holes and therefore time and energy required for dehydration can be reduced to the minimum. Also, in the case where a humidity intercepting layer is provided at an exposed side of the porous body, humidity absorption into the hygroscopic composite material is effected only from the side of the humidity absorbing body to the side of the porous body due to existence of the humidity intercepting layer. Thus, it becomes easier for a difference in vapor pressure at the interface between the humidity absorbing body and the porous body to take place, and condensed water is generated easily in micropores of the porous body.

BRIEF DESCRIPTION OF THE DRAWINGS

The drawings show embodiments of the present invention, in which.

DETAILED DESCRIPTION OF THE INVENTION

Figure 1:
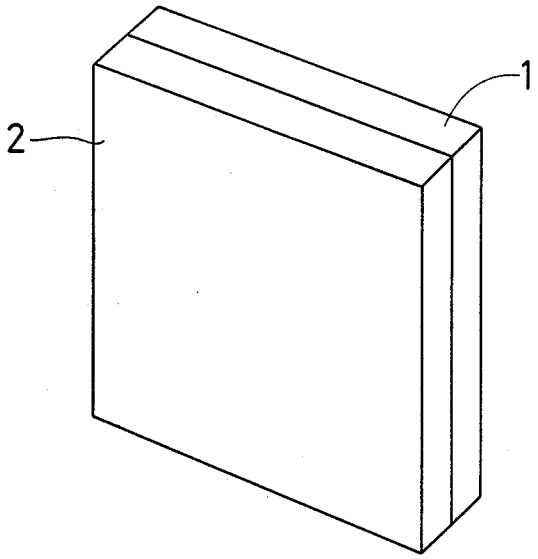
FIG. 1 is a perspective view of a basic embodiment.

An embodiment of the present invention is described below, with reference to FIG. 1 of the drawings. Numeral 1 designates a humidity absorbing body of flat plate shape. A porous body of flat plate shape 2 is fastened to one side of the humidity absorbing body 1 to form a composite body.

The humidity absorbing body 1 has hygroscopic fillers which comprise at least one deliquescent substance, such as calcium chloride, magnesium chloride, lithium chloride, etc., water-soluble high molecule, such as diethylene glycol, triethylene glycol, sodium polyacrylate, PVA, etc., inorganic humidity absorbing material, such as sodium silicate, bentonite, sepiolite, zeolite, activated alumina, molecular sieves, zonotolite, etc., and water-insoluble high molecular humidity absorbing material, such as grafted starch, isobutylene maleic anhydride, polyacrylate, etc., These fillers are incorporated in a basic material having many voids communicating with the open air.

To be concrete, the humidity absorbing material is obtained by kneading together a hydraulic substance, such as cement, plaster, etc. and the hygroscopic fillers into a body and hardening it, by impregnating calcium silicate plate, paper, cloth or the like with hygroscopic fillers, by mixing woody fiber, rock wool fiber or the like with hygroscopic fillers, or by kneading together olefinic resin or the like and hygroscopic fillers and then foaming such mixture. The humidity absorbing body which is obtained by mixing together an inorganic humidity absorbing material, such as bentonite, and calcium chloride, diethylene glycol or the like and then kneading such mixture together with cement or plaster, results in less exudation of hygroscopic fillers and has moderate moisture permeability. This humidity absorbing body is most preferable.

The porous body 2 has many irregularly sized micropores in it, regardless of its material, but it is required that the size of the micropores is such that humidity which has entered in the micropores from the side of the humidity absorbing body and has been retained in almost saturated state condenses by a slight difference in energy. As the result of a measurement by the method of injecting pressurized mercury or other method, it has been found that the average diameter of the pores should be less than $10\mu$, preferably less than $3\mu$.

As the porous body 2 having such micropores, there are available plaster hardened body, cement hardened body, calcium silicate hardened body, and inorganic sintered bodies, such as mullite, bricks, unglazed tiles, etc. Besides, a porous resin body and glass foamed body can be used, so long as the diameter of the pores is less than mentioned above.

However, a porous body made of woody fiber, inorganic fiber plate, paper, felt sheet or the like having voids of the average diameter of more than $20\mu$and good movement of water by capillary phenomenon, is not suitable because generation of condensed water is slight.

As the porous body 2, cement hydrate hardened body is desirable because it shows slight dimensional change and slight lowering of strength in relation to the water and therefore exhibits only a slight lowering of its function, even if condensed water is generated. This cement hydrate hardened body is made chiefly of portland cement, silica cement, alumina cement, calcium silicate or the like and is available as concrete plate, mortar plate, asbestos cement plate, calcium silicate plate, ALC plate, pulp cement plate, GRC plate or the like. The cement hydrate hardened body made of the above material has micropores of the average diameter of less than $10\mu$at the cement hydrate connecting part. As the result of experiments, it has been confirmed that vapor taken in such micropores is easy to condense.

For obtaining the hygroscopic composite material in which the above cement hydrate hardened body and the humidity absorbing body 1 are united, there are available the following methods, i.e., the method of laminating a molded humidity absorbing body 1 and a cement hydrate hardened body to form a composite body, and the method of molding either one of the humidity absorbing body and the cement hydrate hardened body and then coating a paste of the other on the molded body in the desired thickness to form a lamination. It is also possible to laminate cement hydrate hardened body on both sides of the humidity absorbing body 1. A bonding layer which does not disturb moisture permeability, or a water repellent layer, a semipermeable membrane or the like which prevents movement of hygroscopic fillers and water may be put at the joining surface of the humidity absorbing body 1 and the porous body 2.

Also, paper, cloth or a moisture permeable material, such as moisture permeable membrane, plywood, plaster board, rock wool sound-absorbing plate, etc. may be laminated to the exposed side of the humidity absorbing body 1.

Figure 2:
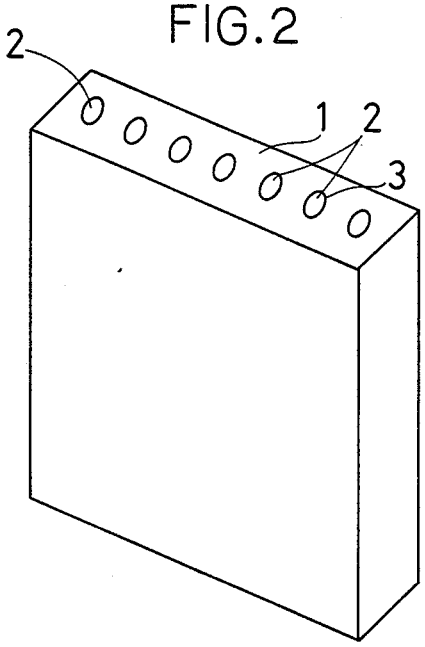
FIG. 2—FIG. 5 are perspective views, each showing a different embodiment.

FIG. 2 - FIG. 6 show different embodiments of the hygroscopic composite material. FIG. 2 shows the hygroscopic composite material in which the humidity absorbing body 1 has a plurality of holes 3 of the proper diameter which pass therethrough vertically, and a porous material in a paste state is filled in said holes 3 and is hardened, or the porous body 2 formed in the same shape as the hole 3 is put in the hole 3.

Figure 3:
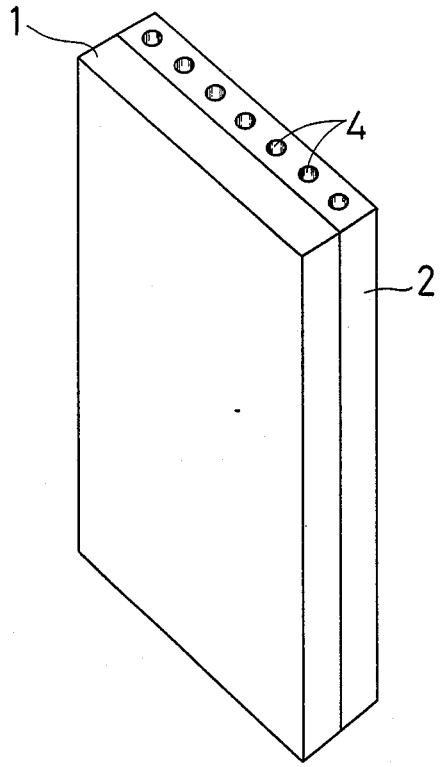
Figure 4:
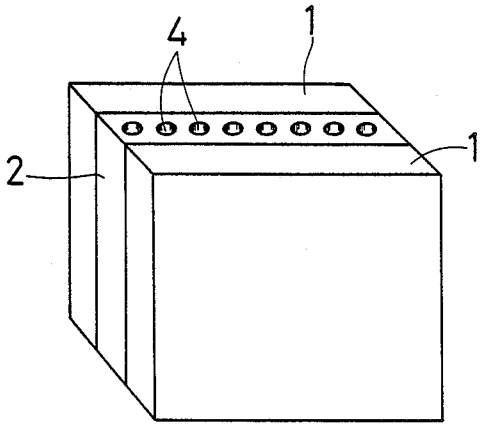

FIG. 3 shows the hygroscopic composite material in which the porous body 2 has a plurality of water discharging holes 4 which pass therethrough vertically for discharging water in the porous body 2 outside. FIG. 4 shows the hygroscopic composite material in which the porous body 2 is sandwiched between two humidity absorbing bodies 1, 1 of flat plate shape. The porous body 2 has a plurality of water discharging holes 4, 4 .... put therethrough vertically. The hygroscopic composite material of such construction can be used as a dehumidifier by decompressing the water discharging holes 4 and dehydrating.

Figure 5:
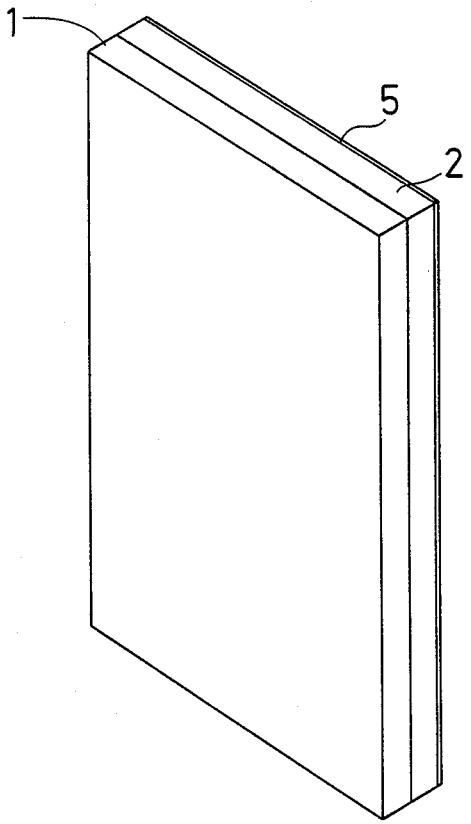
Figure 6:
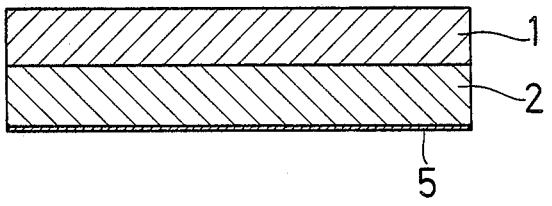
FIG. 6 is a cross-sectional view of the embodiment shown in FIG. 5.

FIG. 5 and FIG. 6 show the hygroscopic composite material in which a humidity intercepting layer 5 is provided at an exposed side of the porous body 2 so as to avoid humidity absorption from that side. The humidity intercepting layer 5 preferably comprises a sheet or a membrane whose percentage of moisture permeation is les than $1\times10^{-4}$ g/m·h·mmHg. The humidity intercepting layer 5 is formed by laminating a resin sheet, such as polypropylene, polyethylene, vinyl chloride, cellophane or the like, a sheet-like substance made by applying metallic evaporation to such sheets as above, a moistureproof sheet, or a metallic sheet to the porous body 2, or may be formed by coating resin liquor, such as silicone, urethane, polyester or the like, on the surface of the porous body 2.

Concrete embodiments of the present invention and comparative examples are shown below.

EMBODIMENT 1

A hygroscopic composite material was obtained by using triethylene glycol as hygrascopic filler, by kneading together 20 weight parts of triethylene glycol and 100 weight parts each of plaster and water, forming such kneaded mixture into a flat plate of 15 mm in thickness and hardening it into a humidity absorbing body, and by laminating a calcium silicate plate of 9 mm in thickness sold on the market (the average diameter of micropores=0.6μ) to one side of the humidity absorbing body.

EMBODIMENT 2

Instead of the humidity absorbing body of the above Embodiment 1, the humidity absorbing body was formed by kneading together portland cement:bentonite:$CaCl_2$:diethylene glycol:water at the weight ratio of 350:700:105:105:500. The hygroscopic composite material was obtained by laminating a calcium silicate plate to the humidity absorbing body.

EMBODIMENT 3

Instead of the humidity absorbing body of the above Embodiment 1, the humidity absorbing body was obtained by mixing together polyvinyl chloride:sodium polyacrylate:plasticizer and others at the ratio of 36:36:28 and by heating and foaming such kneaded mixture by the paste calender method. The hygroscopic composite material was obtained by laminating a calcium silicate plate to the humidity absorbing body.

EMBODIMENT 4

The hygroscopic composite material was obtained by forming a porous body (the average diameter of micropores at a substantial part=2.3μ) by kneading together plaster and water at the ratin of 100:50, forming a plurality of water discharging holes which pass vertically therethrough and hardening it, and laminating the porous body to one side of the humidity absorbing body of the same composition as the above Embodiment 1.

EMBODIMENT 5

Instead of the porous body of Embodiment 4, the hygroscopic composite material was obtained by laminating an extrusion molded cement calcium silicate plate (the average diameter of micropores=0.6μ) to the humidity absorbing body of the above Embodiment 4.

EMBODIMENT 6

A hygroscopic composite material was made in which a polypropylene sheet of 20μ thickness is bonded to the surface of the porous body of the above Embodiment 4.

EMBODIMENT 7

Instead of the porous body of the above Embodiment 4, the hygroscopic composite material was formed by laminating a calcium silicate plate (the average diameter of micropores=0.6μ) to the humidity absorbing body of the above Embodiment 4 and by coating urethane resin on the calcium silicate plate at the rate of 10 g/square shaku.

COMPARATIVE EXAMPLE 1

A zonotolite calcium silicate plate of 25 mm thickness was used as a hygroscopic material sold on the market.

COMPARATIVE EXAMPLE 2

The hygroscopic composite material was obtained by laminating filter paper (average diameter of micropores=20μ), instead of the porous body of Embodiment 1, to the humidity absorbing body of Embodiment 1.

In the above Embodiments 1–7 and Comparative Examples 1 and 2, the percentages of water content at the time when the hygroscopic composite material and each porous body and humidity absorbing body composing a hygroscopic material were caused to absorb humidity until they reach equilibrium in a desiccator of 95% RH, were as follows: Humidity absorbing body: 70% Calcium silicate plate: 15% Plaster hardened body: 5% Extrusion molded cement calcium silicate plate: 13% Zonotolite calcium silicate plate: 25% Filter paper: 20 %

Also, each humidity absorbing body and porous body of the above Embodiments 1–7 and Comparative Examples 1 and 2 were regulated for humidity by 35% RH and then respective hygroscopic composite material was composed and was left to absorb humidity for seven days in a desiccator of 95% RH. Each porous body and humidity absorbing body of these hygroscopic composite materials were measured for the percentage of water content, with the following results.

Humidity absorbing body: 20–25% Plaster hardened body: 15% Calcium silicate plate: 20 % Extrusion molded cement calcium silicate plate: 20 % Filter paper: 5%

The water adsorbed quantity (increase of weight) of the humidity absorbing body in Embodiments 1–7 was within the range of 180–20 00 g/m$^2$, as compared with 450 g/m$^2$ for the hygroscopic material of Comparative Example 1.

From the above results, it is understood that porous bodies in Embodiments 1–7 show weight increase which is higher than the percentage of saturated moisture content, which means that more free water is generated in the porous body.

On the other hand, in the case of Comparative Example 2, it has been confirmed that movement of water from the humidity absorbing body to the filter paper is slight due to the low percentage of water content of filter paper, even if filter paper presents good capillary phenomenon.

When the hygroscopic composite materials of Embodiments 1–7 and Comparative Example 2 were caused to absorb humidity for 14 days continuously, those hygroscopic composite materials of Embodiments 1–7 showed trickling down of water from the porous body but no trickling down of water was observed in the Comparative Example.

What is claimed is:

1. A hygroscopic composite material comprising:

a porous body selected from the group consisting of a cement hardened body, a plaster hardened body, a calcium silicate hardened body and an inorganic sintered body, having many micropores with an average diameter of less than 10μ; and a humidity adsorbing body which comprises a hydraulic substance having incorporated therein a water-soluble moisture absorbing chemical, said humidity absorbing body being laminated to one side of said porous body;

wherein said porous body and said humidity absorbing body are so composed that a steam pressure differential is generated about the interface therebetween to enable said humidity absorbing body to absorb moisture and transfer the absorbed moisture into said micropores of said porous body, and to enable the moisture thus transferred into said micropores to be converted into water.

2. A hygroscopic composite material as defined in claim 1, wherein said hydraulic substance is cement or plaster.

3. A hygroscopic composite material as defined in claim 1, further comprising water discharging holes through which water formed in said porous body is discharged outside said composite material.

4. A hygroscopic composite material as defined in claim 1, further comprising a second said humidity absorbing body laminated to the other side of said porous body.

5. A hygroscopic composite material as defined in claim 4, further comprising water discharging holes through which water formed in said porous body is discharged outside said composite material.

6. A hygroscopic composite material as defined in claim 1, wherein the porous body and the humidity absorbing body are of flat plate shape.

7. A hygroscopic composite material as defined in claim 1, further comprising a humidity intercepting layer provided which covers the other side of said porous body.

8. A hygroscopic composite material as defined in claim 7, wherein the humidity intercepting layer comprises a sheet or a membrane whose percentage of moisture permeation is less than $1\times10^{-4}$ g/m·h·mmHg.

* * * * *